United States Patent [19]

Nakabayashi et al.

[11] 4,288,166

[45] Sep. 8, 1981

[54] APPARATUS FOR PRODUCTION OF STABLE SLURRY OF MILLED COAL AND A HYDROCARBON OIL

[75] Inventors: Yasuyuki Nakabayashi, Yokohama; Yoshio Matsuura, Funabashi; Masashi Hatano, Yono; Tatsuo Hagiwara, Funabashi; Masaaki Mikamo; Yoshimasa Ebihara, both of Chiba; Yasutomo Tomura, Narita; Keiji Imai, Tonemachi, all of Japan

[73] Assignees: Electric Power Development Co. Ltd., Tokyo; Kawasaki Jukogyo Kabushiki Kaisha, Kobe, both of Japan

[21] Appl. No.: 30,868

[22] Filed: Apr. 17, 1979

[30] Foreign Application Priority Data

Jun. 16, 1978 [JP] Japan ..... 53-72176

[51] Int. Cl.[3] ..... B01F 15/06

[52] U.S. Cl. ..... 366/149; 366/144; 366/154; 366/155; 366/156; 241/101 D; 241/176; 241/17; 241/21; 241/24; 241/15; 44/51

[58] Field of Search ..... 44/51, 1 R; 241/17, 241/21, 24, 15, 176, 101 D; 366/144, 149, 154, 155, 156

[56] References Cited

U.S. PATENT DOCUMENTS

| | | | |
|---|---|---|---|
| 2,131,308 | 9/1938 | Blumner | 44/51 |
| 2,231,513 | 2/1941 | Stillman | 44/51 |
| 2,448,042 | 8/1948 | Miller | 366/149 |
| 2,471,487 | 5/1949 | Granath | 366/149 |
| 2,623,737 | 12/1952 | McEachran | 366/144 |
| 2,795,404 | 6/1957 | Cornell, Jr. | 366/144 |
| 3,381,944 | 5/1968 | Clary | 366/220 |
| 3,752,447 | 8/1973 | Chen | 366/149 |
| 3,932,145 | 1/1976 | Foulke | 44/51 |

*Primary Examiner*—Jacqueline V. Howard
*Attorney, Agent, or Firm*—Haseltine and Lake

[57] ABSTRACT

The apparatus comprises a milling machine including a heated rotatable drum connected to means for supplying coarsely crushed coal and preheated oil to the drum wherein the coal becomes finely ground and homogeneously mixed with the oil, and having a discharge duct rotatably connected to the drum and slidably connected to a stationary discharge tower in which the coal/oil slurry is separated from water evaporated from the coal during milling.

7 Claims, 9 Drawing Figures

APPARATUS FOR PRODUCTION OF STABLE SLURRY OF MILLED COAL AND A HYDROCARBON OIL

BACKGROUND OF THE INVENTION

This invention relates to a process and an apparatus for producing a liquid mixture in slurry state which is formed by mixing particles of coal with a hydrocarbon oil and grinding or milling the coal particles together with the oil. The slurry-state liquid mixture thus obtained can be sprayed and burned by a burner. In a preferred embodiment of this invention, the coal particles are subjected to wet milling with a preheated hydrocarbon oil, such as fuel oil.

Heretofore, there have been various technological developments and applications relating to the production of slurry-state fluids by mixing a hydrocarbon oil, such as fuel oil obtained by distillation of crude oil, for uses such as burner fuel with a coal after it has been milled into fine powder for the purpose of obtaining a fluid mixture convenient for pipeline conveyance or of obtaining a fluid mixture of high calorific value.

In addition to its use as a fuel as mentioned above, a coal/hydrocarbon oil slurry of this character has attracted attention in view of its uses as a starting material for various chemical processes.

This coal/hydrocarbon oil slurry is required, of course, to have an unchanging quality not only in its production process but also in its states of transportion and storage. Accordingly, the requisites which this slurry must fulfil are that the coal particles thus mixed be fine particles, that they be of a specific particle size distribution, that they maintain a homogeneously dispersed state, and that sedimentation separation and coagulation lumping of the coal particles must not occur.

The conventional process for producing this liquid mixture of coal and a hydrocarbon oil has comprised, fundamentally, subjecting lumps of coal to drying and milling processes thereby to render the same into powdered coal and suitably agitating this powdered coal with a hydrocarbon oil such as fuel oil thereby to disperse the coal particles and thoroughly mix the same with the oil into a slurry state.

In the above described known technique, however, a most serious problem is the danger of dust explosion in the process of producing dry finely powdered coal from coal in the form of lumps. This danger is especially great in the processing of coal of low degree of carbonization, containing a large amount of volatile materials. Accordingly, expensive safety equipment for eliminating this danger is required, whereby the production cost becomes high, and, moreover, a high level of skill is required for carrying out the processing operation.

On the other hand, in the process of mixing and agitating finely powdered coal and a hydrocarbon oil, also, the need for special devices, an increase in the required space for equipment, and an increase in the required power cannot be avoided because of the requirement for ample shearing force and residence (retention) time. This process, moreover, has a very poor operational efficiency.

Consequently, it is very difficult to obtain in a stable manner by this process a slurry in which finely powdered coal of uniform particle size distribution is thoroughly mixed with uniform dispersion in a hydrocarbon oil.

SUMMARY OF THE INVENTION

It is an object of this invention to provide a novel process and apparatus for carrying out wet-type milling of a coal and a hydrocarbon oil thereby to mill the coal without the danger of coal dust explosion and, at the same time, to carry out mixing and agitation of the coal and oil with uniform dispersion of coal particles throughout the resulting liquid mixture.

Another object of the invention is to provide a process and apparatus as stated above wherein the hydrocarbon oil is preheated before being supplied to the milling process to impart heat directly to the coal particles and thereby not only to increase the fluidity of the process materials and facilitate the agitating and mixing but also to cause water originally contained in the coal particles to evaporate and be separated.

Still another object of the invention is to provide a process and apparatus as stated above wherein secondary heating is imparted to the process materials thereby to improve the total thermal efficiency and to produce a liquid mixture of the coal and oil in the form of a stable slurry.

According to this invention in one aspect thereof, briefly summarized, there is provided a process for producing a liquid mixture in slurry state of a coal and a hydrocarbon oil, which process comprises: supplying the coal into a milling machine; simultaneously supplying the oil in preheated state into the milling machine; imparting a combined milling, agitating, and mixing action to the coal and oil in the milling machine thereby to produce a liquid mixture in slurry state; and, at the same time, separating by evaporation any water originally contained in the coal from the liquid mixture.

According to this invention in another aspect thereof, there is provided an apparatus for producing a liquid mixture of a coal and a hydrocarbon oil comprising: a milling machine, means for supplying into the milling machine the coal which previously has been coarsely crushed; means for supplying the hydrocarbon oil into the milling machine; a device for preheating the hydrocarbon oil prior to its being thus supplied into the milling machine; means for operating the milling machine to mill, agitate, and mix therein the coal and the oil thereby to form a liquid mixture thereof; means for taking the liquid mixture out of the milling machine; and means for removing from the interior of the milling machine any water which was originally contained in the coal and which has been separated by evaporation from the liquid mixture.

The nature, utility, and further features of this invention will be apparent from the following detailed description with respect to a preferred embodiment of the invention and some modifications thereof when read in conjunction with the accompanying drawings, which are briefly described below, and throughout which like or equivalent parts are designated by like reference numerals.

DETAILED DESCRIPTION

As summarized hereinbefore, this invention in one aspect thereof provides a process for producing a liquid mixture in slurry form by mixing coal and a hydrocarbon oil, as described below in detail.

Figure 1:
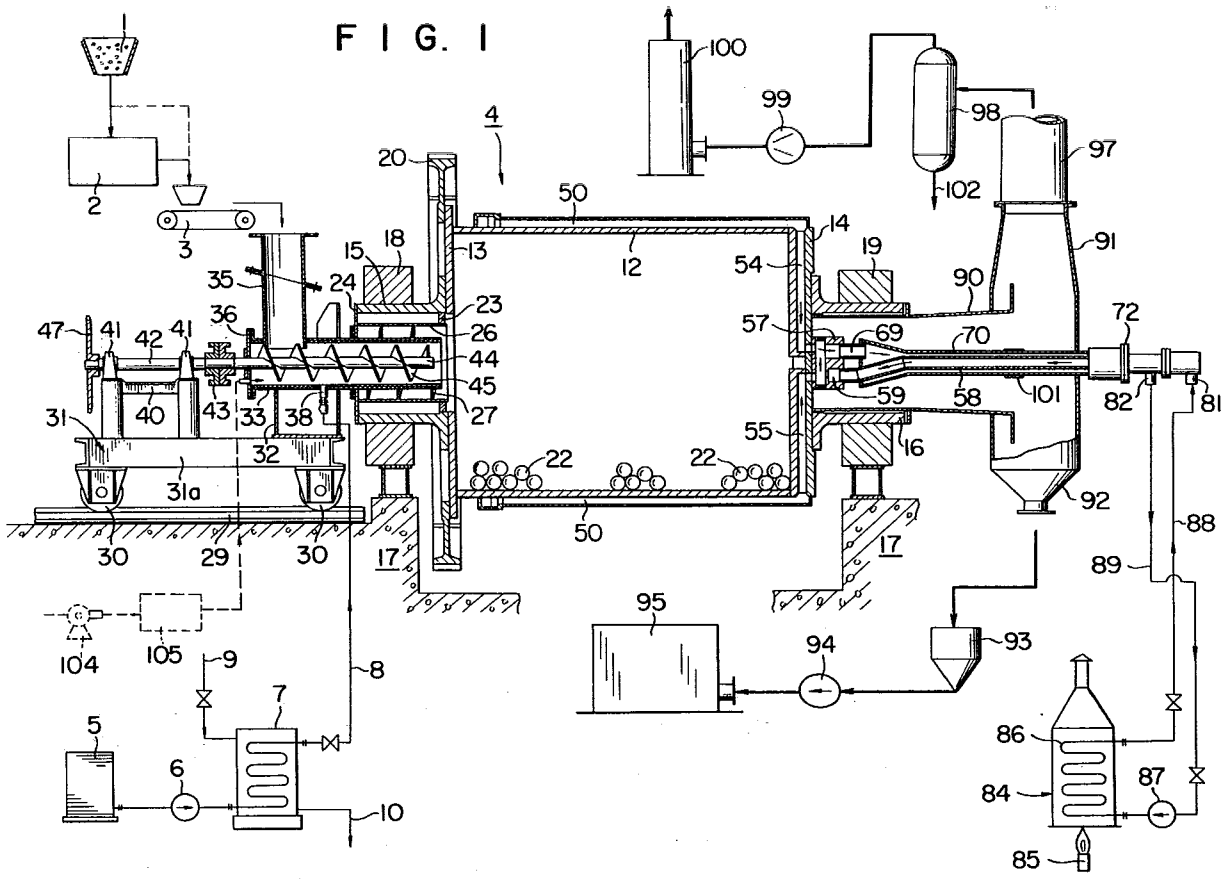
FIG. 1 is a side elevation, with some parts cut away, some parts shown in vertical section, and some parts shown in schematic form, showing one example of an apparatus according to this invention.

A coal such as coke, anthracite, bituminous coal, or brown coal is subjected beforehand to suitable coarse crushing and then is fed into the apparatus of the invention through a coal supplying device 1 such as a hopper as shown in FIG. 1. From the hopper 1, the coal is sent to a metering and feeding device 3 either directly or by way of a particle size adjustment device 2. In the particle size adjustment device 2, the particle size of the coal is ordinarily adjusted to 15 mm. or less or to 20 mm. or less. The metering and feeding device 3 feeds the coal at a specific metered rate into a wet-type ball mill 4, which is a wet-type grinding machine.

On one hand, fuel oil used as the hydrocarbon oil is pumped from a reservoir tank 5 by a pump 6 to a heat-exchange device, where the oil is preheated to a specific temperature. The oil thus preheated is sent through a pipe line 8 into the inlet end of the ball mill 4, where it is mixed with the coal fed into the ball mill, and the coal is ground. The heat-exchange device 7 is supplied with heat from a heating device (not shown) via a heating medium such as steam sent into the heat-exchange device through a pipe line 9. The heating medium after it has given up heat to the fuel oil is discharged from the heat-exchange device 7 through a pipe line 10.

The ratio of the quantities of the coal and the fuel oil fed into the ball mill 4 differs with factors such as the conditions of the wet grinding, resistance to transferring of the slurry, the method of storing the slurry, and the purpose of use of the slurry, but, in general, a high blending ratio such that the coal content becomes 50 percent by weight is desirable. In this connection, depending on the above mentioned conditions and the purpose of use of the slurry, the coal after leaving the coal supplying device 1 is sent directly to the metering and feeding device 3, by-passing the particle size adjustment device 2.

The ball mill 4 used as a wet-type grinder has a construction as described below. This ball mill 4 has a rotary drum 12 rotatably supported to rotate about a horizontal axis of rotation. The inlet or upstream end and outlet or downstream end of this rotary drum 12 in its axial direction are respectively covered by end covers 13 and 14. A boss 15 is integrally secured to the inlet end cover 13, while a boss 16 is integrally secured to the outlet cover 14 and is coaxially aligned with the boss 15. These bosses 15 and 16 are rotatably journaled and supported by bearings 18 and 19, respectively, which are in turn supported on a common base or foundation 17. Thus, the rotary drum 12 is rotatably supported at its bosses 15 and 16 by the bearings 18 and 19. The rotary drum is driven in rotation by a driving power source (not shown) through a pinion (also not shown) meshed with a large gear 20 fixed to the inlet end cover 13.

Similarly as in a conventional ball mill, a large number of metal balls 22 to function as rolling structures for the double purposes of agitation and grinding are provided in free state within the interior of the rotary drum 12.

Figure 2:
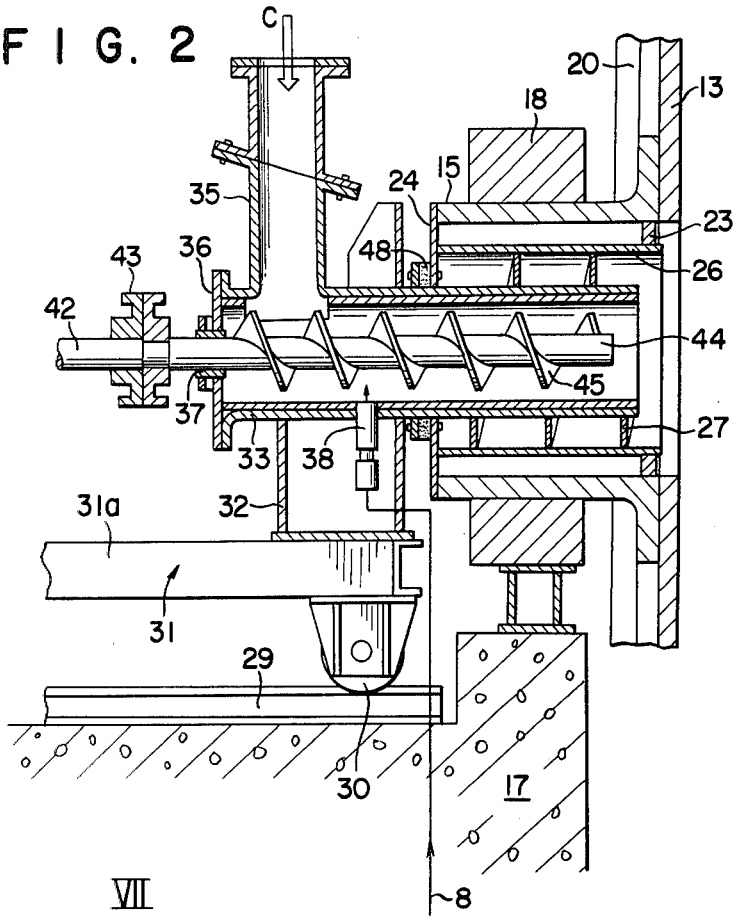
FIG. 2 is a relatively enlarged side elevation, with some parts cut away and some parts shown in vertical section, showing the material supply part of the milling machine of the apparatus shown in FIG. 1.

An annular inner flange 23 is fixed at its radially outer periphery to the inner wall surface of the boss 15 at its inner end (or right-hand end as viewed in FIGS. 1 and 2) and is fixed at its radially inner rim to the inner end of a sealing cylinder 26 disposed coaxially within the boss 15. An annular outer flange 24 is fixed at its outer peripheral part to the outer end of the boss 15 and is fixed also to the outer end of the sealing cylinder 26. The flange 24 extends radially inward beyond the outer end of the sealing cylinder 26 toward a feed tube 33 described hereinafter. A helical sealing screw 27 is fixed to the inner wall surface of the sealing cylinder 26 in coaxial relation thereto.

As shown in FIG. 1, a pair of rails 29 is laid on the base 17 and disposed in parallel relation to the axial direction of the rotary drum 12. A carriage or truck 31 having a chassis **31*a* and wheels 30 is movably supported on these rails 29. A support pedestal 32 is fixedly mounted on the chassis 31*a* at its end nearest the rotary drum 12. As shown in the relatively enlarged side view in FIG. 2, a feed tube 33 is mounted horizontally on the pedestal 32. In the embodiment illustrated in FIGS. 1 and 2, this feed tube 33 comprises two concentric tubes. A coal feed stack 35 is communicatively joined to the upper part of the feed tube 33 at a position near the outer end thereof or the end thereof remote from the rotary drum 12**.

The other end of the feed tube 33, nearest the rotary drum 12, is open, while the outer end of the feed tube 33 is closed by an end cover plate 36, which has a central hole and is provided in this central hole with a bearing bush 37. A fuel oil feeding nozzle 38, to which the downstream end of the aforementioned pipe line 8 is connected, is connected to a side part of the feed tube 33 to inject fuel into the interior thereof. The coal from the aforedescribed metering and feeding device 3 is fed into the above mentioned coal feed stack 35 as indicated by the arrow mark C. The aforementioned preheated fuel oil is fed through the pipe line 8 to the nozzle 38 and injected thereby into the feed tube 33.

A bearing support structure 40 is mounted on the chassis **31*a* of the truck 31 at a position near the end thereof remote from the rotary drum 12. This bearing support structure 40 supports two coaxially aligned bearings 41, which in turn rotatably support a rotating shaft 42. This shaft 42 is coupled at its one end by a coupling 43 to the outer end of a feed screw shaft 44, these two shafts 42 and 44 being coaxially aligned with the feed tube 33. The feed screw shaft 44 is passed through the above mentioned bearing bush 37 and extends into the feed tube 33 through almost the entire length thereof. A feed screw 45 is coaxially secured to the feed screw shaft 44 along its part within the feed tube 33. A sprocket 47 is coaxially fixed to the outer end, or the end remote from the coupling 43, of the shaft 42. The shaft 42 is driven in rotation by a motor (not shown) mounted on the truck 31 through a driving sprocket, an endless chain (also not shown), and the sprocket 47**.

In the case where the truck 31 is moved along the rails 29 in the direction away from the rotary drum 12, the feed tube 33 mounted on the truck 31 is extracted out of and separated from the sealing cylinder 26 and the sealing screw 27. Then, when the truck 31 is advanced in the opposite direction toward the rotary drum 12, the feed tube 33 enters the sealing cylinder 26 through a central hole of the aforedescribed outer flange 24. As the feed tube 33 thus enters the sealing cylinder 26, a seal packing 48 secured to the rim of the central hole of the outer flange 24 elastically contacts the outer cylindrical surface of the feed tube 33, whereby a sealed state is established between the inner rim of the flange 24 and the outer cylindrical surface of the feed tube 33. When the feed tube 33 is fully inserted into its innermost position, its open discharge end is positioned within the interior space of the rotary drum 12.

Figure 3:
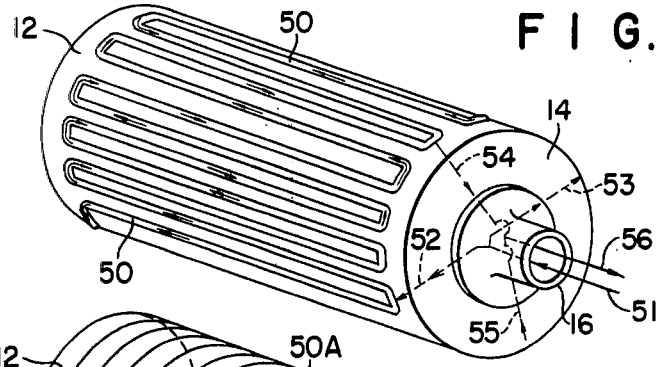
FIG. 3 is a perspective view showing one example of the shape of a heating pipe for heating the cylindrical wall of a rotary drum of the milling machine of the apparatus shown in FIG. 1.

As shown in FIG. 1, a heating medium passageway 50 is provided around the outer cylindrical surface of the rotary drum 12 for the purpose of heating the cylindrical wall of the same. While it is possible for this heating medium passageway to assume almost any form suitable for heating the cylindrical wall of the rotary drum 12, it can be formed, for example, by a pipe bent and installed in a weaving pattern of back-and-forth extensions parallel to the drum axis as shown in FIG. 3. This pipe 50 of weaving pattern can be supplied with a heating medium such as steam introduced as indicated by the arrow mark 51 through the interior of the boss 16 on the outlet side and conducted to the pipe 50 via branch pipe paths 53 and 52. In this case, after passing through the pipe 50 of weaving pattern and heating the cylindrical wall of the rotary drum 12, the heating medium passes through pipe paths 54 and 55 and is conducted outward through the interior of the boss 16 as indicated by the arrow mark 56.

For the purpose of supplying and discharging the heating medium to and from the cylindrical wall of the rotary drum 12 through paths as described above, mechanisms of the construction shown in FIGS. 1 and 4 through 7, for example, can be used.

Figure 4:
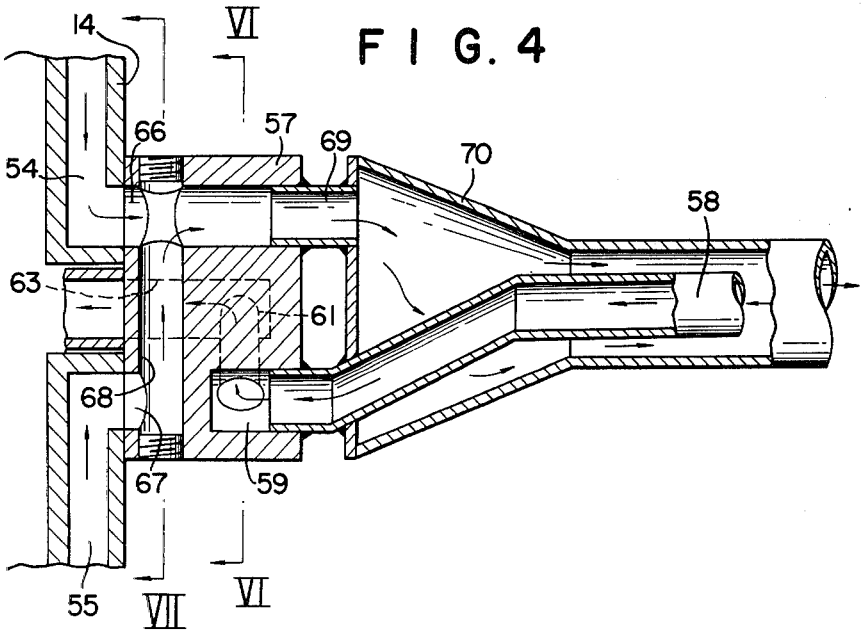
FIG. 4 is an enlarged side elevation, with parts cut away and parts shown in vertical section, of one part on the discharge part of the milling machine of the apparatus shown in FIG. 1.
Figure 6:
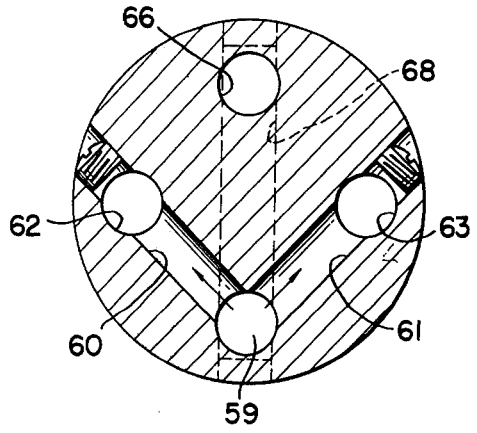
FIG. 6 is a cross section taken along the plane indicated by line VI—VI in FIG. 4 as viewed in the arrow direction.

As shown in FIGS. 1 and 4, a flow passageway coupling block 57 having therewithin passageways for a heating medium is fixed coaxially to the central part of the outer surface of end cover 14 on the outlet side of the rotary drum 12. This block 57 is provided therewithin with an inlet passageway 59 communicating at its outer end with a heating medium supply pipe 58, two passageways 60 and 61 branching from the inlet passageway as shown in FIG. 6, and passageways 62 and 63 communicating with the inner ends of the passageways 60 and 61. Furthermore, the passageways 62 and 63 communicatively connected at their inner ends to the above described pipe paths 52 and 53, respectively, as shown in FIG. 3.

Figure 7:
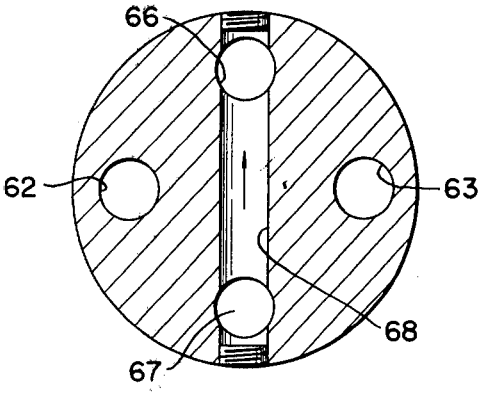
FIG. 7 is a cross section taken along the plane indicated by line VII—VII in FIG. 4 as viewed in the arrow direction.

On one hand, the above described pipe paths 54 and 55 shown in FIG. 3 are communicatively connected to the inner ends of discharge passageways 66 and 67, respectively, also provided in the flow path coupling block 57 as shown in FIG. 4. As shown in FIGS. 4 and 7, the passageway 67 communicates with the passageway 66 through a passageway 68. The passageway 66 extends through the block 57 in a direction parallel to the axial direction of the rotary drum 12 and is communicatively connected at its outer end by way of a pipe 69 to a heating medium discharge pipe 70. This heating medium discharge pipe 70 is disposed relative to the heating medium supply pipe 58 to be coaxially outside thereof and spaced apart therefrom.

As shown in FIG. 1, the heating medium supply pipe 58 and the heating medium discharge pipe 70 extend coaxially relative to and away from the rotary drum 12, and are rotatably supported at their ends remote from the rotary drum 12 by a rotary joint 72.

Figure 5:
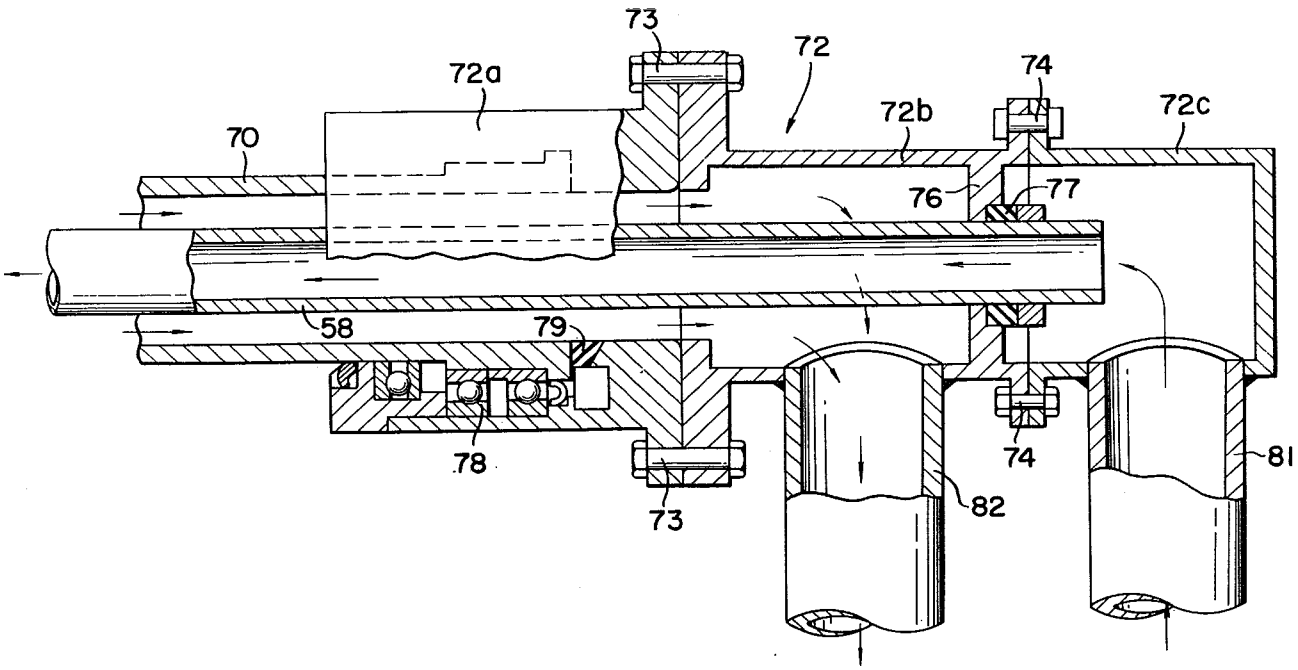
FIG. 5 is an enlarged side view, with parts cut away and parts shown in longitudinal section, showing a rotary joint used in the apparatus illustrated in FIG. 1.

As shown in detail in FIG. 5, this rotary joint 72 comprises, essentially, an inner cylinder **72*a*, a middle cylinder 72*b* having an end wall 76 with a central through hole, and an outer cylinder 72*c* with a closed outer end. These cylinders are integrally secured together in coaxial alignment by bolts 73 and 74 passed through their adjoining joint flanges. The end wall 76 constitutes a bearing which rotatably supports the outer end of the above described heating medium supply pipe 58. In order to isolate the interior space of the middle cylinder 72*b* and that of the outer cylinder 72*c* from each other, the end wall 76 is provided at its central hole with a sealing packing 77, which is fixed to the end wall 76 and is in intimate contact with outer surface of the heating medium supply pipe 58. The inner cylinder 72*a* houses and supports a bearing device 78 for rotatably supporting the outer end of the above described heating medium discharge pipe 70. The inner cylinder 72*a* is provided with a sealing packing 79 interposed between a part of the inner cylinder 72*a* and the extreme end surface of the heating medium discharge pipe 70**.

By the above described construction, the interior of the heating medium supply pipe 58 is communicatively joined to the interior space of the outer cylinder **72*c*, while the interior of the heating medium discharge pipe 70 is communicatively joined to the interior space of the middle cylinder 72*b*. An inlet fitting 81 for introducing the heating medium is communicatively connected to the outer cylinder 72*c*, while an outlet fitting 82 for discharging the heating medium is communicatively connected to the middle cylinder 72*b***. The rotary joint of the above described construction is supported by a fixed structure (not shown) of the apparatus.

Referring again to FIG. 1, the heating medium which flows through the above described passageways and pipe paths is reheated and circulated by a heating medium system of the following organization. The heating medium is heated by a heating medium heating device 84 comprising a fuel burner 85 and a heating tube 86. The heating medium discharged out of the above described rotary joint 72 through the outlet fitting 82 flows through a return pipe line 89 and is pumped by a pump 87 to the heating device 84. The heating medium thus heated is sent through a supply pipe line 88 and enters the rotary joint 72 through the inlet fitting 81.

As shown in FIG. 1, one end of a discharge duct for conducting out the liquid mixture of the coal and the fuel oil produced in the rotary drum 12 is inserted into the inner side of the boss 16 on the discharge side of the rotary drum 12. This discharge duct 90 is fixedly supported and does not rotate when the boss 16 rotates unitarily with the rotary drum 12. The other end of the discharge duct 90 communicates with the interior of a discharge tower 91. The bottom 92 of this discharge tower 91 constitutes a part where the liquid mixture is taken out. The liquid mixture thus taken out is conducted by way of an intermediate tank 93 and a pump 94 to a liquid mixture storage tank 95. The top part 97 of the discharge tower 91 constitutes a part where the discharged gas component is taken out. This top part 97 is connected through a separator 98 and a gas blower 99 to a gas diffusion cylinder 100.

A through opening is provided in a central part of the end cover 14 on the discharge end of the rotary drum 12, and a grating is fitted in this opening, although this constructional feature is not shown in FIG. 1. The interior of the rotary drum communicates through this grating with the interior of the discharge duct 90. Furthermore a bearing 101 is fixedly supported within the discharge lower 91 and serves to rotatably support an intermediate part of the heating medium discharge pipe 70.

The operation of the apparatus of the above described organization according to this invention will now be described.

The rotary drum 12 is driven in rotation by power transmitted from the aforementioned motor (not shown) through the pinion and the gear 20 fixed to the rotary drum. At the same time, the feed screw 45 on the advanced truck 31 is driven by power transmitted from the motor (not shown) through the sprocket 47. On another hand, the heating medium heated by the heating device 84 is sent by the operation of the pump 87 through the supply pipeline 88, the rotary joint 72, the heating medium supply pipe 58, the flow path coupling block 57, and pipe paths 52 and 53 into the heating pipe 50, thereby heating the cylindrical wall of the rotary drum 12. After heating this cylindrical wall of the rotary drum 12, the heating medium flows through the pipe paths 54 and 55, the flow path coupling block 57, the heating medium discharge pipe 70, the rotary joint 72, the return pipe line 89, and the pump 87 to return again to the heating device 84.

With the apparatus in the above described operational state, the coarsely crushed coal is supplied continuously through the coal supply device 1, the particle size adjustment device 2, and the metering and feeding device 3 into the coal feed stack 35 of the ball mill 4. This coal thus enters the feed tube 33 and is conveyed toward the inlet of the rotary drum 12 by the action of the feed screw 45. At the same time, the fuel oil which has been preheated by the heat exchanging device 7 is injected through the nozzle 38 into the feed tube 33 and is mixed with the coal. The coal and the fuel oil mixed in this manner is fed continuously from the open end of the feed tube 33 into the rotary drum 12.

In the rotary drum 12, the coal and the fuel thus fed in a previously mixed state are moved in tumbling motion by the rotation of the rotary drum 12, and the coal pieces agitate the fuel oil. At the same time, the balls 22 within the rotary drum 12 impart a finely grinding action to the coal and, at the same time, uniformly mix the coal and the fuel oil.

The coal and the fuel oil which have been subjected to the above described grinding and mixing action within the rotary drum 12 are heated by the heat within the drum due to the heating of the drum cylindrical wall by the heating medium, whereby activation energy is imparted to the coal and fuel oil. At the same time, the balls 22 are also heated. Consequently, in addition to the above described actions of agitation, grinding, and mixing, the volatile water component of water such as that contained in the coal and the fuel oil separates physicochemically from the liquid mixture of the coal and fuel oil during the rotary milling process and rises to the upper part of the rotary drum 12.

During the above described process, the particles of dust formed as a result of the grinding are intercepted by the agitated surface of the liquid undergoing tumbling. That is, the dust particles are captured within the liquid mixture of the coal and fuel oil because of the tackiness of the liquid mixture and are not swept out together with the exhaust gases.

The coal is ground and mixed by agitation with the fuel oil in this manner and, together with the fuel oil, becomes a completely mixed liquid from which the volatile matter has been evaporated off. This liquid mixture exhibits tackiness as a uniform slurry and at an activation temperature is discharged continuously through the aforementioned grating into the discharge duct 90.

The liquid mixture of the coal and fuel oil thus discharged accumulates in the bottom 92 of the discharge tower 91, from which it is sent to the intermediate tank and, further, is finally stored in the storage tank 95. The liquid mixture thus sent into the storage tank 95 is a thoroughly uniformized or homogenized slurry. For this reason, solid-liquid separation does not occur during its transfer process or at the stage of its storage in the storage tank 95. Accordingly, as a coal-fuel oil mixed fuel, this slurry does not undergo variations in its material characteristics with the lapse of time and can be fed at any time to a device such as a burner. Although heat energy is dissipated from this slurry during the transfer process and during storage, this has no effect whatsoever on the quality of the liquid mixture.

The volatile matter such as water which has evaporated in the rotary drum 12 passes through the discharge duct 90 to enter the discharge tower 91 and then flows through the top part 97 of the tower to the separator 98. In the separator 98 any mist component mixed in free form in the volatile matter is separated from the gases. The mist component becomes a liquid, which is drained out through the bottom of the separator 98 as indicated by 102. The gas leaves the separator 98 from its upper part and is sent by the gas blower 99 to the gas diffusion cylinder 100, from which the gas is dispersed into the atmosphere. While the separation of the mist is carried out in the separator 98, in actual practice, almost all of the mist produced in the rotary drum 12 adheres to the liquid mixture and is thus intercepted because it contacts the liquid mixture, which has tackiness. For this reason, only a very small quantity of mist is sent out of the discharge tower 91.

At the time of maintenance and inspection of the ball mill 4, the truck 31 is retracted away from the rotary drum 12 along the rails 29. As a consequence, the feed tube 33 and the feed screw 45 therewithin are extracted outward, leaving the sealing cylinder 26 and the sealing screw 27. Therefore, cleaning, inspection, and repairing of the interior of the rotary drum 12 can be carried out through the interior of the sealing cylinder 26. The feed screw 45 can also be cleaned, inspected, and repaired.

While, in the embodiment of this invention described above, balls 22 are placed in the ball mill 4, it is also possible to use, instead, metal rods of suitable length.

Furthermore, depending on the necessity, a gas such as air may be sent by a blower 104 through a heating device 105 to be heated and then blown into the feed tube 33 as indicated in FIG. 1 thereby to further impart heat to the mixture of coal and fuel oil.

The hydrocarbon oil used in this invention is not limited to fuel oil, which is used as one example thereof in the above described embodiment of the invention. Other hydrocarbon oils such as a liquid obtained from distillation of fuel oil may be used instead.

Furthermore, the grinding machine 4 is not limited to an ordinary ball mill but may be some other equivalent means such as a vibratory ball mill or an agitation mill.

Figure 8:
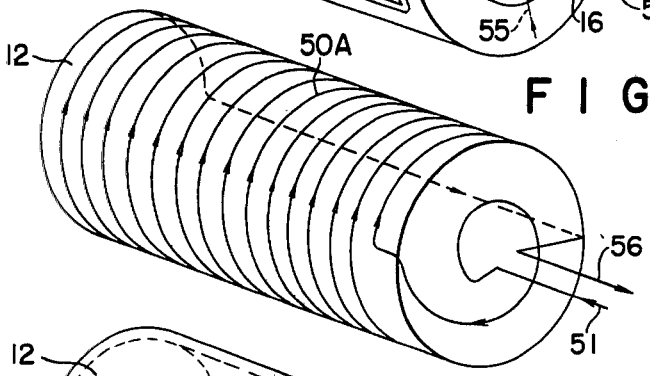
FIGS. 8 and 9 are perspective views respectively showing examples of modifications of means for heating the cylindrical wall of the rotary drum of the milling machine.
Figure 9:
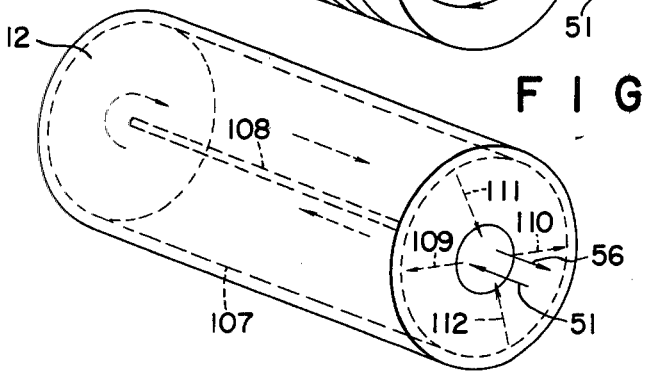

Still other modifications are possible in the means for heating the cylindrical wall of the rotary drum 12. For example, instead of using the heating pipe 50 installed in a weaving pattern as shown in FIG. 3 as means for heating the cylindrical wall of the rotary drum 12, a heating pipe 50A in the form of a helical coil as indicated in FIG. 8 may be used. Still another heating system comprises, as indicated in FIG. 9: a drum cylindrical wall of double-shell construction 107 with a hollow space between the inner and outer shells; baffles 108 suitably installed in the hollow space for guiding the heating medium through an effective flow path as indicated by arrows; means for supplying and returning the heating medium as indicated by the arrow marks 51 and 56; pipe paths 109 and 110 for conducting the heating medium thus supplied to the hollow space; and pipe paths 111 and 112 for conducting the heating medium to the return path.

In this invention as described above, the method of applying heat to the milling process, such as the heating of the cylindrical wall of the mill drum or the introduction of a hot gas into the drum, is optional, but the preheating of the hydrocarbon oil prior to the supplying thereof into the milling machine is a requisite. Since the heat capacity of a milling machine, such as, for example, a ball mill, in entirety is large, a tremendous quantity of heat energy is necessary for heating the entire machine. In contrast, the preheating of the hydrocarbon oil prior to the supplying thereof into the milling machine is accompanied by small heat energy loss. Moreover, immediately after it is injected into the milling machine, the hydrocarbon oil directly contacts the coal, whereby the aforedescribed actions such as the moisture evaporation action are rapidly and efficiently carried out. Then, the numerous cycles of colliding and abrading actions of the rolling elements such as balls relative to the coal particles as well as the contacting, mixing, and diffusing actions of the solid, liquid, and gaseous matter in the machine are effectively carried out.

According to this invention, since the hydrocarbon oil is always present in the milling machine, the milling machine functions as a wet-type milling machine. This means that a dry fine-grinding process, as in known processes, for milling of the coal is not carried out. Accordingly, the danger of explosion due to fine coal dust is eliminated, and safe operation becomes possible. This means the advantageous possibility of reducing safety equipment by that much.

Furthermore, as a beneficial result of the heated state of the coal particles and the hydrocarbon oil in the milling machine, the moisture in the coal can be readily removed. Therefore, there is no necessity to dry the coal beforehand. In addition, by increasing the fluidity of liquid mixture in slurry state formed in the milling machine, it becomes possible to form a uniform dispersed phase.

The liquid mixture in slurry state produced in accordance with this invention, irrespective of whether it is used as a fuel or whether it is used as a chemical starting material, has several advantageous features, among which are small fluctuation of coal ratio, infrequency of presence of coarsely large coal particles, non-occurence of sedimentation, separation, coagulation, and hardening, and good stable quality.

What we claim is:

1. An apparatus for producing a liquid mixture of a coal and a hydrocarbon oil comprising: a ball mill (4) including a substantially horizontal rotary drum having a horizontal axis and inlet and outlet end covers (13,14), said rotary drum having inlet and outlet bosses (15, 16) of cylindrical shape respectively fixed with mutually coaxial alignment to said inlet and outlet end covers and extending axially outwardly of the drum; heat applying means (50) disposed around and secured to the outer surface of the drum; bearing means (18, 19) for rotatably supporting said bosses; means (44, 45, 38) for supplying through said inlet boss (15) into the rotary drum the coal which previously has been coarsely crushed and the hydrocarbon oil; means (7) for preheating the hydrocarbon oil prior to its being thus supplied into the rotary drum; means (20) for rotating the rotary drum to mill, agitate, and mix therewithin the coal and the oil thereby to form a liquid mixture; a discharge duct (90) fixedly connected to said outlet boss (16) so as to be rotatable with the outlet boss for conducting therethrough the liquid mixture as well as any water, which was originally contained in the coal and which has been separated by evaporation from the liquid mixture, out of the rotary drum; a stationary discharge tower (91) slidably supporting therein the free end of said discharge duct (90) so as to receive the liquid mixture and water thereinto, said discharge tower having a bottom part (92) to which the liquid mixture flows down and a top part (97) through which the volatile matter flows upward; means (94) for conducting the liquid mixture from said bottom part to a storage tank (95); and means (99) for drawing out the water from said top part, further comprising heating medium supply and discharge pipe means (58, 70) extending longitudinally through said discharge duct (90) and said discharge tower (91) and having one end connected to said heat applying means (50) and the other end disposed outside said discharge tower for supplying and discharging a heating medium to and from the heat applying means (50), said supply and discharge pipe means being rigidly connected to the rotary drum and rotatable therewith; and a rotary joint (72) connecting said pipe means to heating means (84, 87) for heating and circulating the heating medium.

2. An apparatus according to claim 1, further comprising means (105) for blowing a hot gas against the coal being supplied into the rotary drum in substantially the direction of supplying of the coal.

3. An apparatus according to claim 1 in which said means for supplying the coal and the hydrocarbon oil is mounted on a truck (31) movable toward and away from the milling machine.

4. An apparatus according to claim 1 in which said means for supplying the coal and the hydrocarbon comprises a feed tube (33) opening into the rotary drum, a feed screw (45) rotatably disposed within the feed tube and extending coaxially with the feed tube for supplying the coal, and an oil feeding nozzle (38) opening into the feed tube.

5. An apparatus according to claim 1 in which said heat applying means is a heating medium passage pipe (50) secured on the outer surface of the rotary drum in a weaving pattern of extensions parallel to the axis of the drum.

6. An apparatus according to claim 1 in which said heat applying means is a heating medium passage pipe (50A) secured on the outer surface of the rotary drum in a helical coil pattern.

7. An apparatus according to claim 1 in which said heat applying means is a double shell structure (107) with a hollow space in which baffles (108) are disposed to guide the heating medium.

* * * * *